US011247810B2

(12) United States Patent
Hundeloh et al.

(10) Patent No.: US 11,247,810 B2
(45) Date of Patent: Feb. 15, 2022

(54) LID FOR AN ALUMINUM BEVERAGE CAN

(71) Applicant: BALL BEVERAGE PACKAGING EUROPE LIMITED, Bedfordshire (GB)

(72) Inventors: Thomas Hundeloh, Bad Marienberg (DE); Olaf Joeressen, Meerbusch (DE); Pim Van Dam, EC Epe (NL); Ralf Wersuhn, Bornheim (DE)

(73) Assignee: Ball Beverage Packaging Europe Limited, Bedfordshire (GB)

( * ) Notice: Subject to any disclaimer, the term of this patent is extended or adjusted under 35 U.S.C. 154(b) by 218 days.

(21) Appl. No.: 16/303,855

(22) PCT Filed: May 17, 2017

(86) PCT No.: PCT/EP2017/061816
§ 371 (c)(1),
(2) Date: Nov. 21, 2018

(87) PCT Pub. No.: WO2017/202662
PCT Pub. Date: Nov. 30, 2017

(65) Prior Publication Data

US 2020/0047944 A1 Feb. 13, 2020

(30) Foreign Application Priority Data

May 24, 2016 (DE) ..... 10 2016 109 570.2

(51) Int. Cl.
*B65D 17/34* (2006.01)
*B65D 17/28* (2006.01)

(52) U.S. Cl.
CPC .. *B65D 17/4012* (2018.01); *B65D 2517/0014* (2013.01); *B65D 2517/0062* (2013.01);
(Continued)

(58) Field of Classification Search
CPC .... B65D 2517/0014; B65D 2517/0073; B65D 2517/0071
See application file for complete search history.

(56) References Cited

U.S. PATENT DOCUMENTS 3,877,606 A 4/1975 Silver
3,990,603 A 11/1976 Brochman
(Continued)

FOREIGN PATENT DOCUMENTS

AU 2009289732 3/2010
CN 2647756 10/2004
(Continued)

OTHER PUBLICATIONS

International Search Report issued by the European Patent Office for International Patent Application No. PCT/EP2017/061816, dated Jul. 27, 2017, 7 pages.
(Continued)

*Primary Examiner* — Allan D Stevens
(74) *Attorney, Agent, or Firm* — Sheridan Ross P.C.

(57) ABSTRACT

The invention refers to a can lid for an aluminum beverage can. The can lid has a pull tab, a chuck wall defining a plug diameter, a countersink and central panel having a panel radius. On the central panel, a score line defining a tear panel and a rivet for connecting a pull tab to the can lid are arranged. The rivet extends through a rivet island that is arranged between an opening part of the pull tab and a handle part of the pull tab. The lid has lid plug diameter of between 45 to 49 mm, an outside diameter of between 52 to 55 mm and a weight of less than 1.9 grams. The central panel has a thickness of less than 0.19 mm. The score line defines an area of between 300 $mm^2$ to 350 $mm^2$ and the score line has a shortest distance from the panel radius of less than 3 mm.

18 Claims, 12 Drawing Sheets

(52) U.S. Cl.
CPC ..... *B65D 2517/0071* (2013.01); *B65D 2517/0082* (2013.01)

(56) References Cited

U.S. PATENT DOCUMENTS

| | | | | |
|---|---|---|---|---|
| 4,012,935 | A * | 3/1977 | Holk, Jr. | B21D 17/02 72/325 |
| 4,994,009 | A | 2/1991 | McEldowney | |
| 5,224,618 | A | 7/1993 | Garbiso | |
| 5,248,053 | A * | 9/1993 | Lundgren | B65D 17/165 220/269 |
| 6,354,453 | B1 | 3/2002 | Chasteen | |
| 6,763,963 | B1 | 7/2004 | Martin | |
| 7,089,825 | B2 | 8/2006 | Klosterman et al. | |
| 7,594,585 | B1 * | 9/2009 | Fields | B65D 17/4012 220/269 |
| 7,975,884 | B2 | 7/2011 | Mathabel et al. | |
| 8,464,887 | B2 | 6/2013 | Cherian | |
| 9,033,174 | B2 * | 5/2015 | Chasteen | B65D 17/4012 220/269 |
| 9,181,006 | B2 | 11/2015 | Neiner et al. | |
| 9,254,945 | B2 | 2/2016 | McClung et al. | |
| 2002/0108954 | A1 * | 8/2002 | Cho | B65D 17/4012 220/269 |
| 2002/0170913 | A1 | 11/2002 | Yamasaki et al. | |
| 2005/0252917 | A1 * | 11/2005 | Turner | B65D 17/28 220/269 |
| 2007/0108208 | A1 * | 5/2007 | Dickie | B65D 17/4012 220/269 |
| 2008/0099480 | A1 | 5/2008 | Chang | |
| 2012/0031056 | A1 | 2/2012 | Chasteen et al. | |
| 2014/0054332 | A1 * | 2/2014 | Mcclung | B65D 17/4012 222/541.9 |
| 2014/0263328 | A1 | 9/2014 | Rayburn et al. | |
| 2015/0239607 | A1 | 8/2015 | Fields et al. | |
| 2015/0367984 | A1 | 12/2015 | Forrest et al. | |
| 2016/0031594 | A1 | 2/2016 | Ramsey et al. | |

FOREIGN PATENT DOCUMENTS

| | | |
|---|---|---|
| CN | 2661596 | 12/2004 |
| CN | 101568474 | 10/2009 |
| CN | 105416765 | 3/2016 |
| CN | 104684813 | 9/2017 |
| CN | 107352119 | 11/2017 |
| DE | 102014211265 | 12/2015 |
| EP | 2612823 | 7/2013 |
| JP | 2000-185736 | 7/2000 |
| JP | 2013-180817 | 9/2013 |
| RU | 2495805 | 10/2013 |
| WO | WO 2009/090171 | 7/2009 |
| WO | WO 2013/172783 | 11/2013 |
| WO | WO 2014/031926 | 2/2014 |
| WO | WO 2014/150180 | 9/2014 |
| WO | WO 2014/165209 | 10/2014 |

OTHER PUBLICATIONS

Written Opinion issued by the European Patent Office for International Patent Application No. PCT/EP2017/061816, dated Jul. 27, 2017, 9 pages.
U.S. Appl. No. 16/305,661, filed Nov. 29, 2018, Hundeloh et al.
Third Party Observation for International (PCT) Patent Application No. PCT/EP2017/061816, dated Sep. 21, 2018 3 pages.
Third Party Observation for International (PCT) Patent Application No. PCT/EP2017/061863, dated Sep. 29, 2018 1 page.
International Search Report and Written Opinion for International (PCT) Patent Application No. PCT/EP2017/061863, dated Jun. 22, 2017 12 pages.
Decision to Grant for European Patent Application No. 17724028.0, dated May 14, 2020 33 pages.
Official Action for Australia Patent Application No. 2017273675, dated Apr. 29, 2020 7 pages.
Official Action for Canada Patent Application No. 3,025,959, dated Jan. 8, 2020 4 pages.
Decision to Grant for European Patent Application No. 17726231.8, dated Jan. 30, 2020 5 pages.
Official Action for European Patent Application No. 17724028.0, dated Sep. 10, 2019 8 pages.
Official Action for Australia Patent Application No. 2017273675, dated Aug. 30, 2019 6 pages.
Official Action for Canada Patent Application No. 3,025,959, dated Nov. 12, 2019 3 pages.
Official Action with English Translation for China Patent Application No. 201780041108.7, dated Oct. 23, 2019 26 pages.
Intention to Grant for European Patent Application No. 17724028.0, dated Nov. 5, 2020 34 pages.
Notice of Acceptance for Australia Patent Application No. 2017273675, dated Aug. 31, 2020 4 pages.
Notice of Allowance for Canada Patent Application No. 3,025,959, dated Nov. 10, 2020 1 page.
Notice of Allowance with English Translation for China Patent Application No. 20178004108.7, dated Jul. 27, 2020 5 pages.
Second Intention to Grant for European Patent Application No. 17726231.8, dated Jun. 19, 2020 5 pages.
Intention to Grant for European Patent Application No. 17726231.8, dated Nov. 26, 2020 38 pages.
Official Action for U.S. Appl. No. 16/305,661, dated Feb. 9, 2021 8 pages Restriction Requirement.

* cited by examiner

LID FOR AN ALUMINUM BEVERAGE CAN

CROSS REFERENCE TO RELATED APPLICATIONS

This application is a national stage application under 35 U.S.C. 371 of PCT Application No. PCT/EP2017/061816, having an international filing date of 17 May 2017, which designated the United States, which PCT application claimed the benefit of German Application Serial No. 10 2016 109 570.2, filed 24 May 2016, both of which are incorporated by reference in their entirety.

FIELD

The invention refers to can lids for two-piece aluminum beverage cans.

The invention refers to two-piece aluminum beverage cans with a unitary drawn and wall-ironed can body and can lid with a pull tab.

BACKGROUND

Two piece beverage cans comprise a can body made from one piece of aluminum sheet metal and a can lid with a pull tab affixed to the can lid. A score line in a panel of the can lid defines a tear panel that can be opened by means of the pull tab. The pull tab can be a stay-on-tab that opens a hinged tear panel. In prior art cans, the pull tab is affixed to the can end by a rivet that is formed from the sheet metal of the can lid. Can lids are also known as can ends.

The can body is a drawn and ironed (DWI: drawn and wall-ironed) can body that is produced by first drawing an aluminum blank into a cup and then ironing the walls of the cup to form the can body. The can body has an open end with a reduced diameter. The reduced diameter of the can body's open end is achieved by way of necking the can body in a necking machine in which the diameter of the open end is reduced in several stages.

Prior art cans often have a body that is cylindrical along the largest portion of its longitudinal extension. A typical diameter of prior art aluminum beverage cans is 66 mm. These cans are named 211 cans in the industry.

After filling of a can body e.g. with a carbonated beverage, a respective can lid is attached to the can body by way of a folded double seam. The can lid has a smaller diameter than the can body.

To match a respective can lid, the can body diameter at the can body's open end is reduced from 66 mm to the fitting diameter for the can lid, e.g. ~57 mm (206), 55 mm (204), 52 mm (202) or 50 mm (200) by way of necking.

A typical can body has a base and a cylindrical sidewall that extends upwardly from the base and that has a wall thickness in the order of 94 to 97 μm for a can having a diameter of 66 mm. A can having a diameter of 58 mm typically has a wall thickness in the order of 90 to 94 μm. The can body further has a tapering neck that extends upwardly from the cylindrical sidewall and that defines the reduced diameter open end of the can body prior to seaming. The can body's open end has a smallest internal diameter called plug diameter, which approximately matches the metrical dimension of the can lid, e.g. 52 mm.

The ratio between the can maximum diameter and the plug diameter that is achieved by way of necking is called the necking ratio. The base includes a standing ring and a dome arranged within the standing ring.

The can lid is made from sheet metal aluminum and has a central panel wherein the rivet and the tear panel are arranged. The central panel is circumferentially surrounded by a countersink that in turn is circumferentially surrounded by an upwardly extending leg, e.g. a chuck wall. At the outer end of the upwardly extending leg, a curl is arranged that eventually is folded to form the seam that connects can body and can lid and that defines the lid outside diameter. The can lid's chuck wall defines a plug diameter of the can lid.

On the central panel, a rivet for connecting a pull tab and a tear panel defined by a score line are arranged. The tear panel can be opened by means of the pull tab that breaks the score line, when a handle part of the pull tab is lifted and thus an opening part of the pull tab is pressed on the tear panel next to the score line. Between the handle part and the opening part of the pull tab a rivet island is arranged. The rivet island is connected to the central panel by means of the rivet and that serves as a bending hinge for the pull tab.

It is an object of the invention to provide a can lid for an improved two-piece aluminum beverage can.

SUMMARY

According to the invention, this object is achieved by a can lid for an aluminum beverage can. The can lid comprises a pull tab. Further, the can lid has a chuck wall defining a plug diameter, a countersink and central panel having a panel radius. On the central panel, a score line defining a tear panel and a rivet for connecting a pull tab to the can lid are arranged. The rivet extends through a rivet island that is arranged between an opening part of the pull tab and a handle part of the pull tab. The lid has lid plug diameter of between 45 to 49 mm, an outside diameter of between 52 to 55 mm and a weight of less than 1.9 grams. The central panel has a thickness of less than 0.19 mm. The score line defines an area of between 300 $mm^2$ to 350 $mm^2$ and the score line has a shortest distance from the panel radius of less than 3 mm.

Preferably, absorption beads are arranged next to the tear panel and no absorption bead is provided along a panel radius section, where the tear panel comes closest to the panel radius at a score line apex.

In a preferred embodiment, the rivet is arranged at or near the center of central panel.

Further, it is preferred if the can lid has a rivet island that it is fixated to the central panel by means of the rivet. The rivet is tilted with respect to a normal to a plane defined by countersink. Thus, the axis of rotation defined by the rivet is tilted with respect a normal to a plane defined by the countersink. The tilt of the rivet facilitates lifting of a handle part of the pull tab if the pull tab is rotated about the rivet. Accordingly, the handle part may extend to close proximity of the chuck wall and can still be gripped by a user's finger when the pull tab is rotated.

Preferably, the rivet is tilted by an angle of between 1° and 9°, for instance 2° to 5°, with respect to the normal to the plane defined by the countersink.

According to a preferred embodiment, the central panel has diameter of between 36 mm and 40 mm.

The can lid preferably has two material adsorption beads that are symmetrically arranged on both sides of the pull tab and the tear panel. The two material absorption beads are separated by a bead gap where the tear panel comes closest to the panel radius at a score line apex.

The pull tab has an axis of symmetry and can rotate around the rivet. Preferably, the axis of symmetry of the pull tab initially is orientated at an angle of between 5° to 30° with respect to an axis defined by the rivet and a center of the tear panel or the apex of the score line. Accordingly, the pull tab is initially not aligned with the tear panel and therefore first must be aligned prior to opening the tear panel. Aligning the pull tab requires a rotation of the pull tab around the tilted rivet which not only results in an alignment of the pull tab with the tear panel but also results in a lifted handle part of the pull tab that thus can be gripped easier.

In addition to a tilt of the rivet or as an alternative, at least one ramp-up bead can be provided that is arranged on either side or on both sides of the pull tab. The ramp-up bead can also cause or support a lifting of the handle part if the pull tab is rotated about the axis of the rivet. Preferably, the ramp-up bead is arranged on the central panel.

Further, one or more orientation beads can be provided that are configured and arranged to support aligning of the initially rotated pull tab in a position suitable for opening the tear panel. For instance, such orientation bead can be configured to provide a click-in effect when the pull tab is rotated about the rivet and eventually reaches its aligned orientation. The click-in effect can be achieved by means of a gap between two ramp-up beads that receives a part of the pull tab. In such embodiment, the ramp-up beads may also serve as orientation beads that provide a tactile feedback to a user when the pull-tap is orientated in its opening position.

The can end is made from sheet metal, for instance from aluminum or steel that may be pre-coated or plain.

BRIEF DESCRIPTION OF THE DRAWINGS

The above and other aspects, features and advantages of the present invention will be more apparent from the following more particular description thereof, presented in conjunction with the following drawings wherein.

DETAILED DESCRIPTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
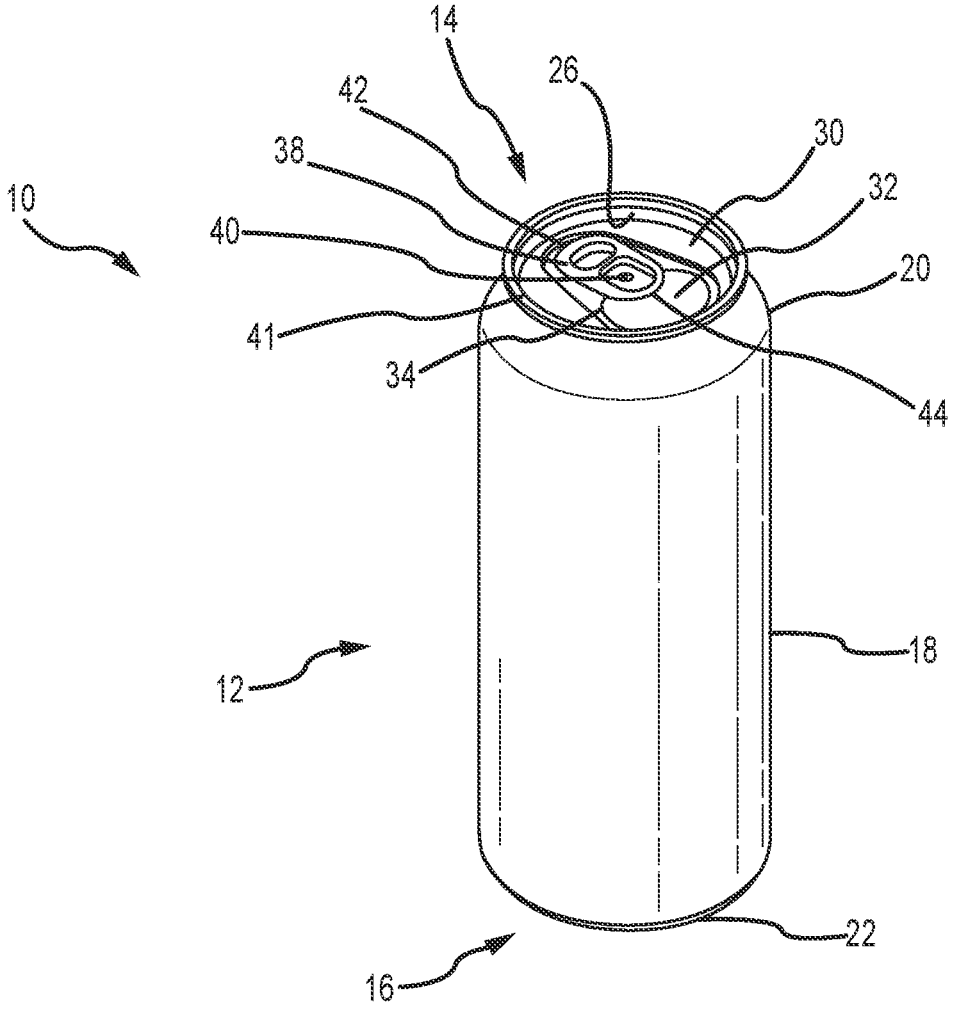
FIG. 1 is a side-elevated perspective view of a seamed two-piece beverage can according to the invention.

FIG. 1 shows a two piece aluminum beverage can 10 according to the invention. The can comprises a can body 12 and a can lid 14 seamed to the can body. The can body 12 is a unitary DWI (drawn and wall-ironed) can body and the can lid 14 has a pull tab 38.

The can body 12 is formed from a single piece of aluminum sheet metal (blank) and has a base 16, a cylindrical sidewall 18 and a neck 20. The base 16 has a standing ring 22 and a dome 24. The can body 12 is preferably made from aluminum, in particular from series 3000 aluminum.

The can lid 14 has a chuck wall 26, a countersink 28 and a central panel 30. In the central panel, a tear panel 32 is provided which is defined by a score line 34. Next to the tear panel, a material absorption bead may be arranged. Pull tab 38 is affixed to the central panel 30 by means of a rivet 40. A central section of the pull tab 38 is a rivet island 50 that is fixated to the central panel 30 by means of the rivet 40. Typically, the pull tab 38 can be rotated about the rivet 40 if a certain force is applied. The axis of rotation is perpendicular with respect to a plane defined by the rivet island 50. The pull tab 38 has a handle part 42 to be gripped by a user's finger and an opening part 44 that is pressed against the tear panel 32 if the handle part 42 is lifted by a user. Thus, the pull tab 38 serves to rupture the score line 34 in order to open the beverage can 10 in a known manner. The tear panel 32 thus defines the dimensions of the opening created by lifting the handle part of the pull tab 38. The tear panel defines an opening for instance a drinking opening—having an area of between 300 $mm^2$ to 350 $mm^2$ after opening the beverage can.

The can lid 14 is fixed to the can body 12 by means of a folded double seam 41. The seam 41 has a diameter of between 46 mm and 49 mm.

The diameter L of the seam 41 (illustrated in FIG. 2) is approximately 48 mm. The diameter J of the stand ring 22 (illustrated in FIG. 3) is smaller than the diameter L of the seam 41. Therefore, beverage cans can be stacked upon one another, so that the stand ring of the upper can protrudes into the space within the seam 41. Alternatively, the stand ring may have a larger diameter than the seam.

The can body 12 has a can body plug diameter of between 45 to 49 mm and a weight below 9.3 g for a 330 ml can, and below 9.7 g for a 355 ml can.

The can lid 14 has a can plug fitting diameter of between 45 to 49 mm, an outside diameter of between 52 to 55 mm, a central panel with a thickness of less than 0.19 mm, e.g. 0.183 mm, and a weight of less than 1.9 g.

Figure 2:
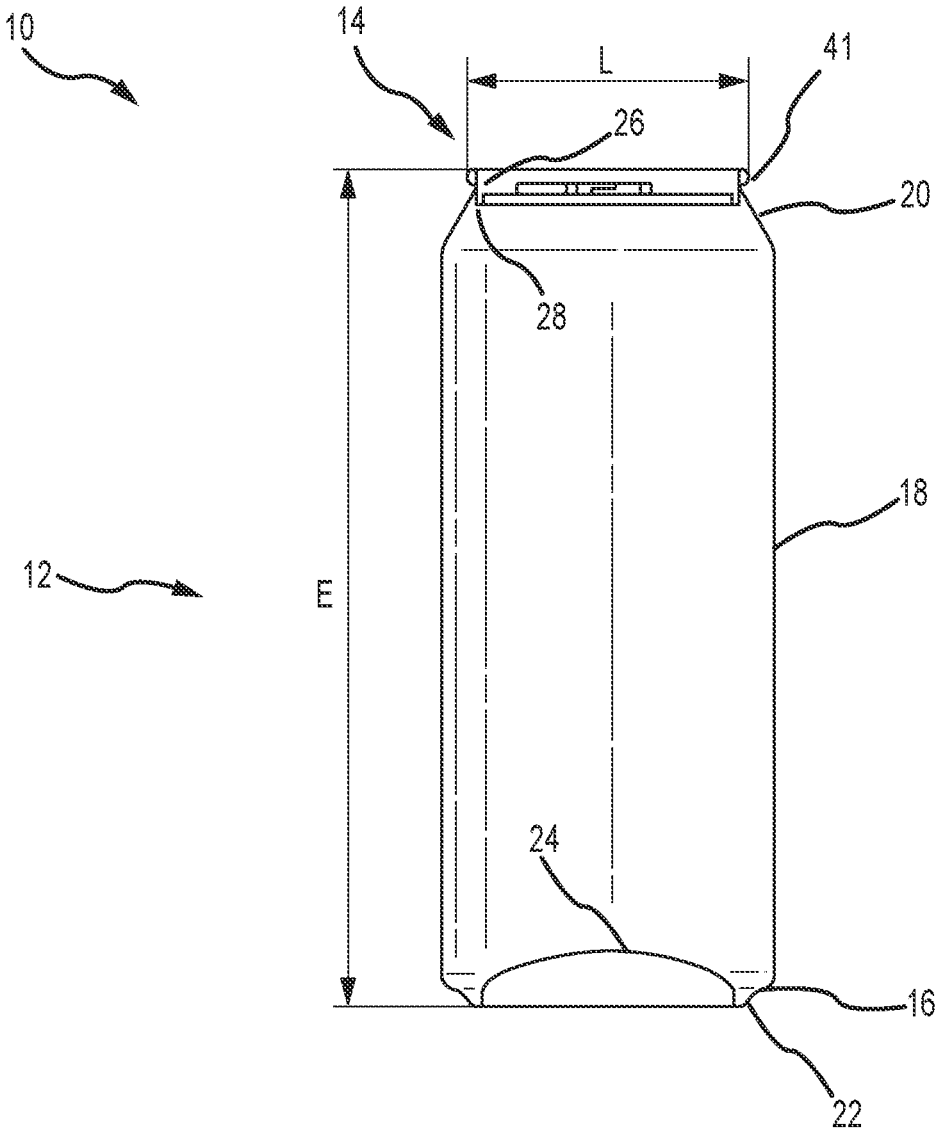
FIG. 2 is a cross-sectional view of a seamed two-piece beverage can along the can's longitudinal axis.

FIG. 2 is a cross-sectional view of the can 10 with the can lid 14 seamed to the can body 12. In the cross-sectional view, the chuck wall 26 and the countersink 28 of the can lid 14 can be seen as well as the cylindrical sidewall 18, the neck 20, the stand ring 22 and the dome 24 of the can body 12.

Figure 3:
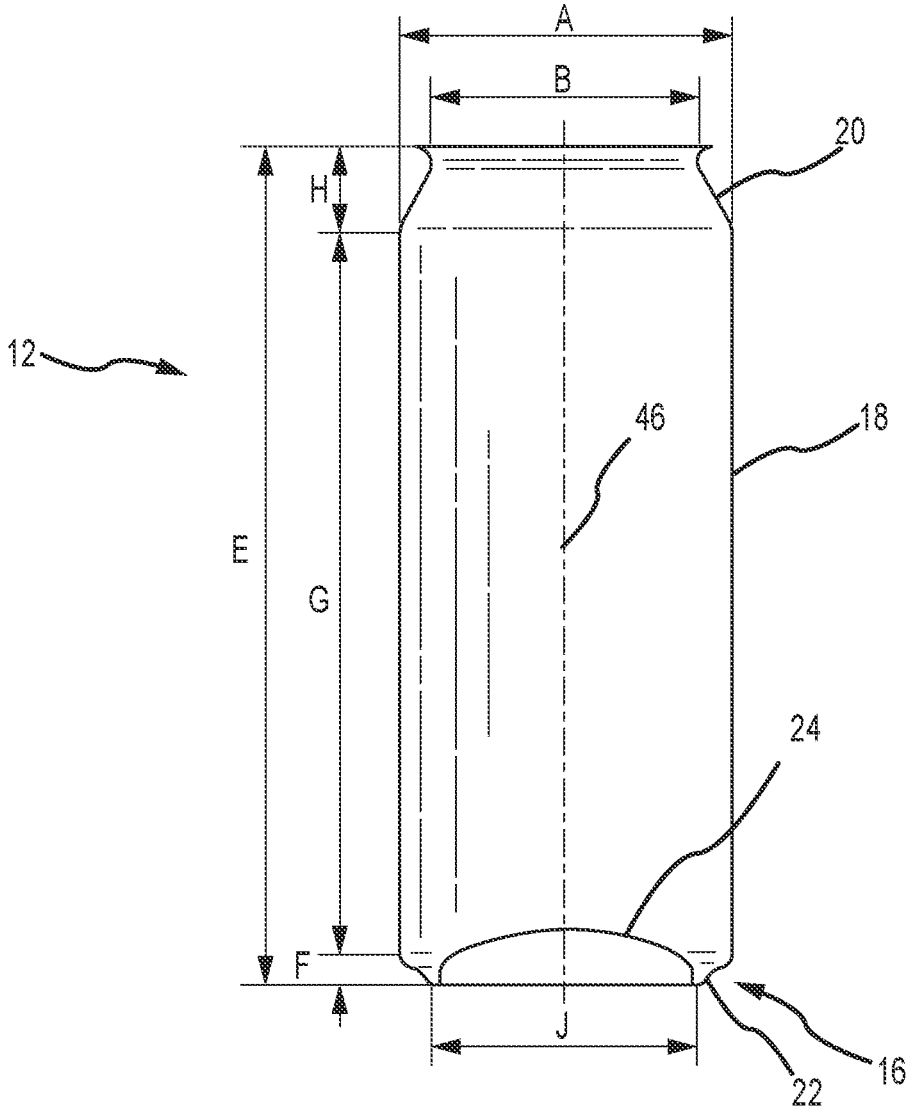
FIG. 3 is a cross-sectional view of a can body prior to seaming.

Referring to FIG. 3, the diameter A of the can is between 56 mm and 59 mm, for instance approximately 58 mm. The can diameter A corresponds to the diameter of the cylindrical sidewall 18. As further can be taken from FIG. 3, the base 16 extends along a height F of about 5 to 10 mm. The cylindrical sidewall 18 has a height G of about 120 mm. The neck 20 has a height H of about 17 mm. The can body 12 is symmetric about a longitudinal axis 46. Prior to sealing, the can body 12 has an upper open end with an inner diameter B, which is called plug diameter, and which is about 46 mm.

Can body 12 is produced by a draw and wall ironing process (DWI), wherein first a cup is formed and then the sidewall is formed by drawing and wall ironing. Thereafter, the neck 20 is formed in a necking machine (necker) to achieve an upper can end that has a smaller diameter than the maximum can diameter. The ratio of the plug diameter B to can diameter A is called the necking ratio. The necking ratio of the can body 12 of the embodiment of FIG. 3 is a little less than 80%.

The can body 12 is drawn from a single piece of aluminum sheet metal, having a gauge of 242 μm. Therefore, the wall thickness in the middle of the dome 24 is approximately 240 μm.

The maximum wall thickness of the can in the middle of the dome 24 of the base 16 is between 235 μm and 245 μm, such as 240 μm or 242 μm. The tool for drawing and wall ironing preferably is configured to create a transitional wall thickness from the base to the sidewall in two steps. The tool preferably provides a first step with an angle of 1° and a second step with an angle of −30°. Thus, the wall thickness of the can body is reduced from about 240 μm in the area of the base to about 79 μm at the middle part of the sidewall 18.

The wall thickness of the middle part of the neck is about 111 μm. The neck has a flange (at its upper end) having a wall thickness in the range of between 130 μm and 150 μm, for instance 140 μm.

The transition from the sidewall 18 to the neck 20 is rounded. The radius in the transition from the sidewall 18 to the neck 20 is between 10 mm and 20 mm, for instance 15 mm. Such a transition is also called "round shoulder".

The angle of the neck 20 relative to the sidewall 18 of a central longitudinal axis 46 of can the body 12 is between 25° and 35°, for instance 30°.

The beverage can 10 has a nominal volume of between 330 ml and 355 ml and a height E of between approximately 145 mm and 147 mm for a 330 ml can and a height E of between 156 mm and 159 mm for a 355 ml can.

A can body according to the embodiments of the Figures has a weight below 9.3 g for a can with a nominal volume of 330 ml and below 9.7 g for a can having a nominal volume of 355 ml.

The total internal volume of the seamed can is the nominal volume plus a head space. The volume of the head space is little less than 20 ml, for instance 18 ml. Thus, a can with a nominal volume of 330 ml has a total internal volume of 348 ml, and a can with a nominal volume of 355 ml has a total internal volume of 373 ml.

Figure 4:
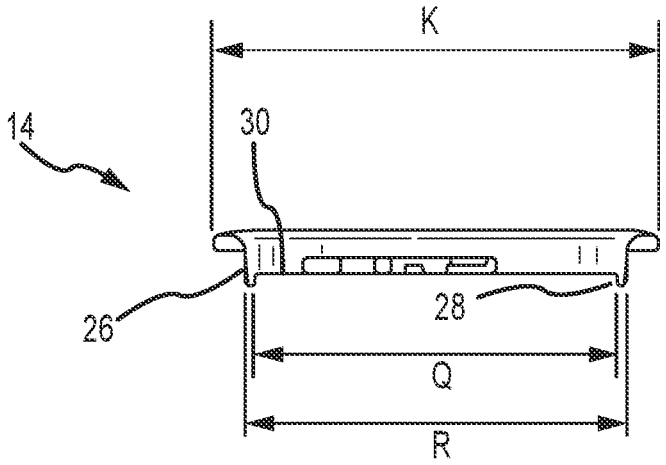
FIG. 4 is a cross-sectional view of a can lid prior to seaming.

FIG. 4 is a cross-sectional view of can lid 14 prior to seaming illustrating the outside diameter (curl diameter) K. FIG. 4 further illustrates a can lid plug diameter R that is defined by the chuck wall 26 and a central panel diameter Q of the central panel 30.

Figure 5:
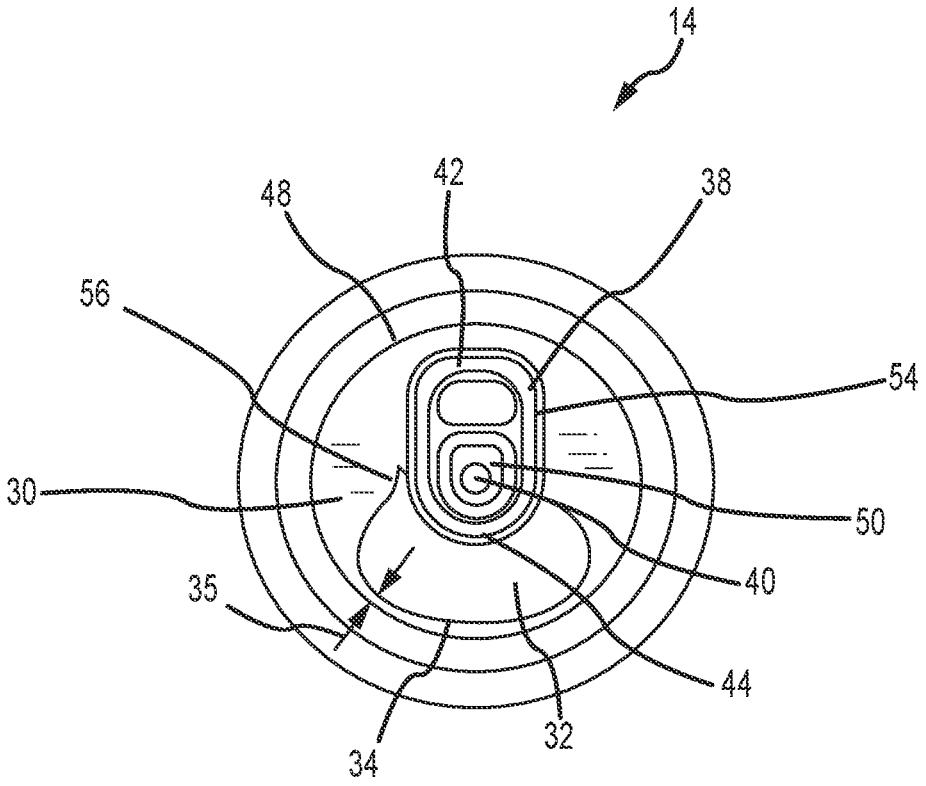
FIG. 5 is a top-level view of a first embodiment of a can lid according to the invention.

FIG. 5 is a top-level view of a first embodiment of a can lid according to the invention. The can lid 14 as illustrated in FIG. 5 has a curl diameter K of 53.31 mm, a can lid plug diameter R of 45.4 mm and central panel diameter Q of 37.55 mm. As can be taken from FIG. 5, on a central panel 30, a central rivet 40 is arranged that connects a rivet island 50 of the pull tab 38 to the central panel 30. The rivet island 50 is an integral part of the pull tab 38 and forms a bendable hinge between a handle part 42 of the pull tab 38 and an opening part 44 of pull tab 38. An outer pull tab curl 54 of the pull tab 38 provides for sufficient stiffness between the handle part 42 and the opening part 44 so that the opening part 44 can exert a strong enough force on the tear panel 32 when the handle part 42 of the pull tab 38 is lifted.

The tear panel 32 is defined by a score line 34 and has an area of 331 $mm^2$ and has a shark fin design featuring a triangular extension 56 next to the rivet that improves pouring because it eases entering of air in the can. The closest distance between a panel radius 48 and the score line 34 of the embodiment of the can lid 14 as shown in FIG. 5 is 1.1 mm at a location indicated by arrows 35. The can lid 14 is made from pre-coated aluminum sheet metal.

Figure 6:
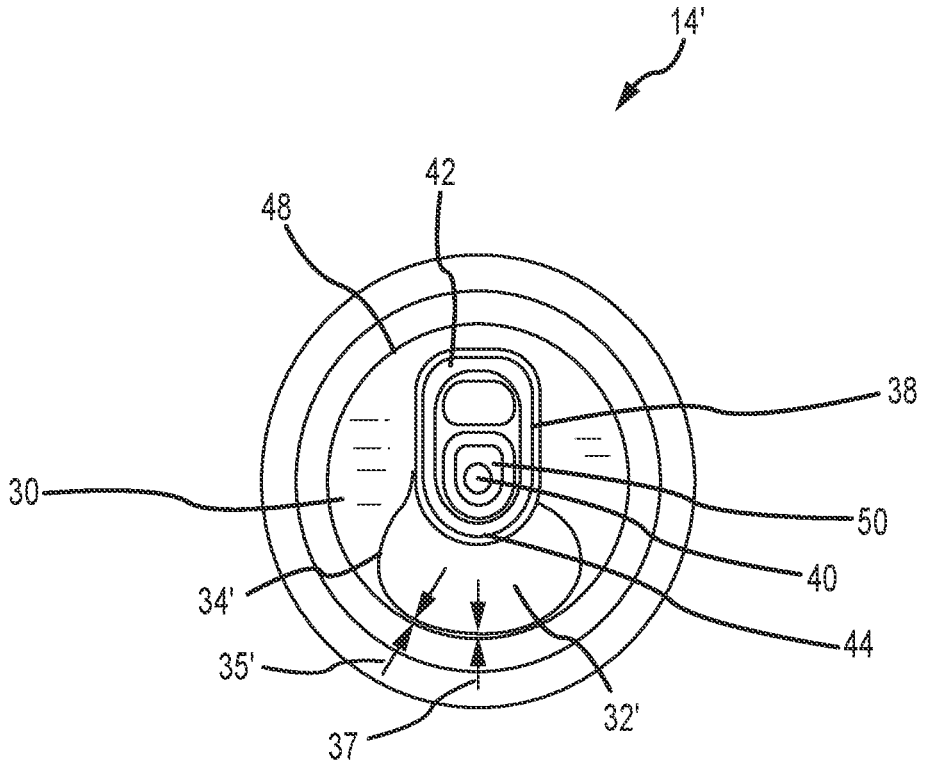
FIG. 6 is a top-level view of a second, alternative embodiment of a can lid according to the invention.

FIG. 6 is a top-level view of a second, alternative embodiment of a can lid 14'. The embodiment of the can lid 14' as illustrated in FIG. 6 differs from can lid 14 as illustrated in FIG. 5 only by the shape of tear panel 32' that is defined by a score line 34'. The area of the tear panel 32' is 334.2 $mm^2$. The closest distance between the score line 34' and the panel radius 48 is 0.99 mm at a point indicated by arrows 35'. The distance between score line 34' and panel radius 48 at the apex of score line 34' is 1.41 mm. The apex of the score line is located on the axis of symmetry defined by the rivet 40 and the tear panel 32' and is indicated by arrows 37.

Figure 7:
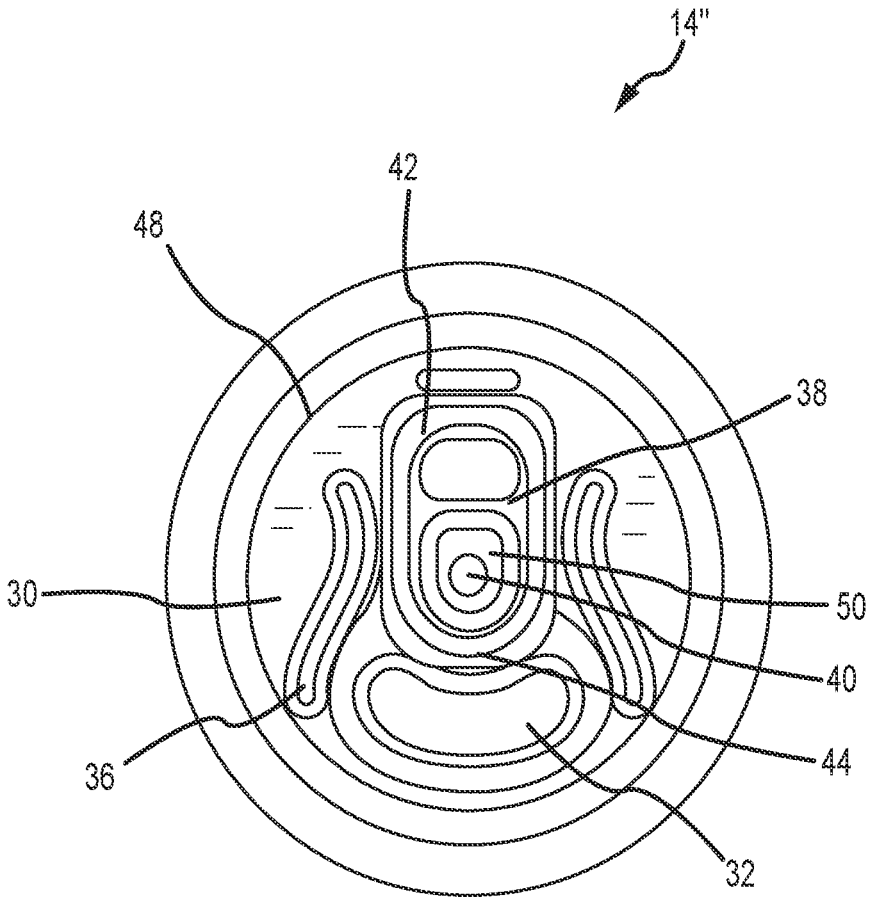
FIG. 7 is a top-level view of a third alternative embodiment of a can lid according to the invention.

FIG. 7 is a top-level view of a can lid 14" similar to the can lid 14 of FIG. 5 or can lid 14' of FIG. 6 that features two material absorption beads 36 that are symmetrically arranged on both sides of the pull tab 38 and the tear panel 32. The two material absorption beads 36 are separated by a bead gap where the tear panel comes closest to the panel radius, e.g. at a score line apex. That means, no material absorption bead is provided where the tear panel 32 comes closest to the panel radius 48.

Figure 8:
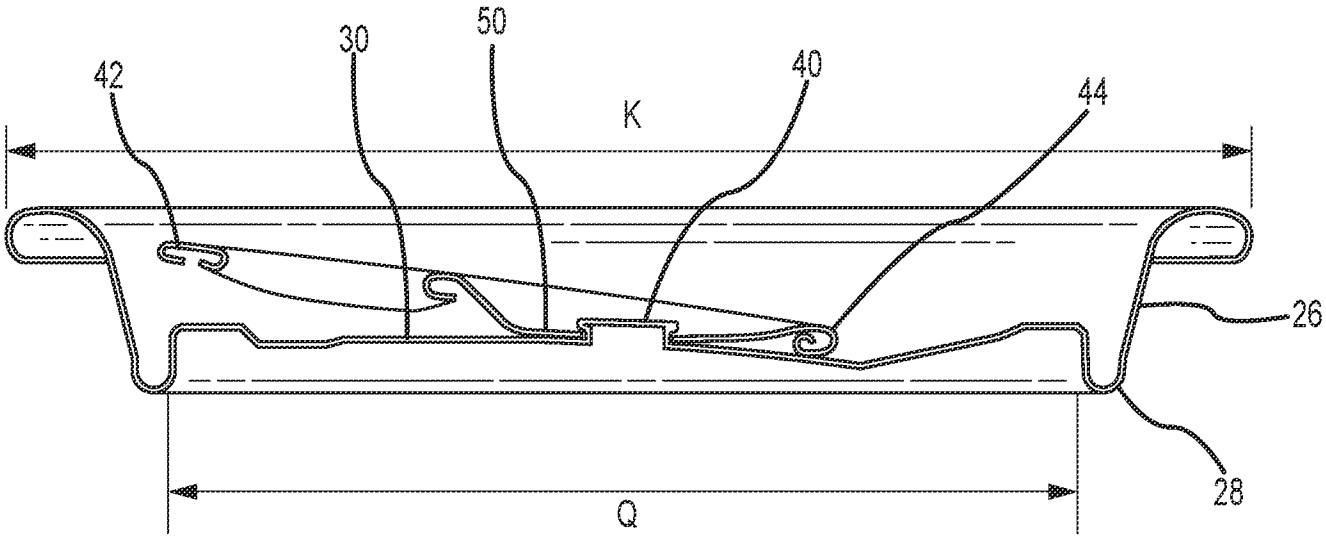
FIG. 8 is a cross-sectional view of an alternative can lid having a tilted rivet prior to seaming.

In order to improve the accessibility of the handle part 42 of the pull tab 38, the rivet 40 may be tilted as shown in FIG. 8. The axis of rotation defined by the rivet 40 is tilted with respect a normal to a plane defined by the countersink 28. Likewise the plane defined by the rivet island 50 has a tilt angle with respect to the plane defined by the countersink 28. The tilt angle is between 2° and 4°, for instance 3°.

Figure 9B:
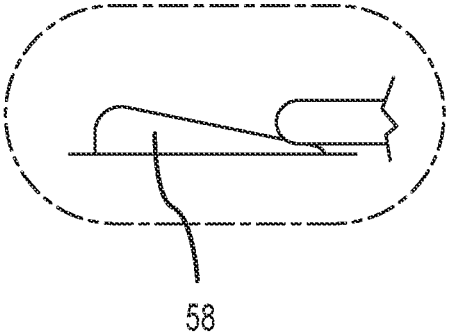
FIG. 9B is an expanded view of a ramp-up bead of FIG. 9.
Figure 9A:
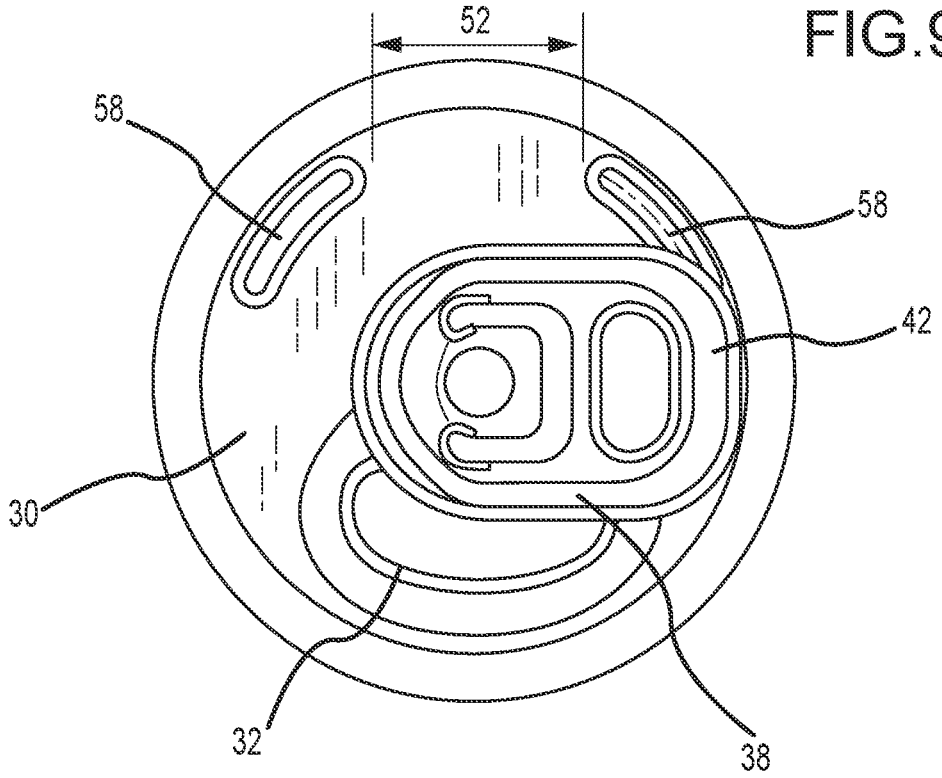
FIG. 9A is a top-level view of a fourth alternative embodiment of a can lid having a pull tab that initially is orientated at an offset-angle with respect to an axis of symmetry defined by the rivet and the tear panel and further having ramp-up beads arranged on either side of the pull tab that assist lifting the pull tab when the pull tab is rotated around an axis of rotation defined by the rivet.

Additionally or alternatively the can lid 14 can have a pull tab that initially is orientated at an offset-angle with respect to an axis of symmetry defined by the rivet and the tear panel as shown in FIG. 9A. In such embodiment, the pull tab 38 first must be aligned with the tear panel 32 in order to allow opening of the tear panel 32. Aligning of the pull tab 38 requires a rotation of the pull tab 38 that can help to lift the handle part 42 of the pull tab 38 so that the handle part 42 can be gripped easier.

Lifting of the handle part 42 of the pull tab 38 can be facilitated by ramp-up beads 58 arranged on either side of the pull tab 38; see FIG. 9A. Ramp-up beads 58 assist lifting the pull tab when the pull tab is rotated around an axis of rotation defined by the rivet.

Figure 10:
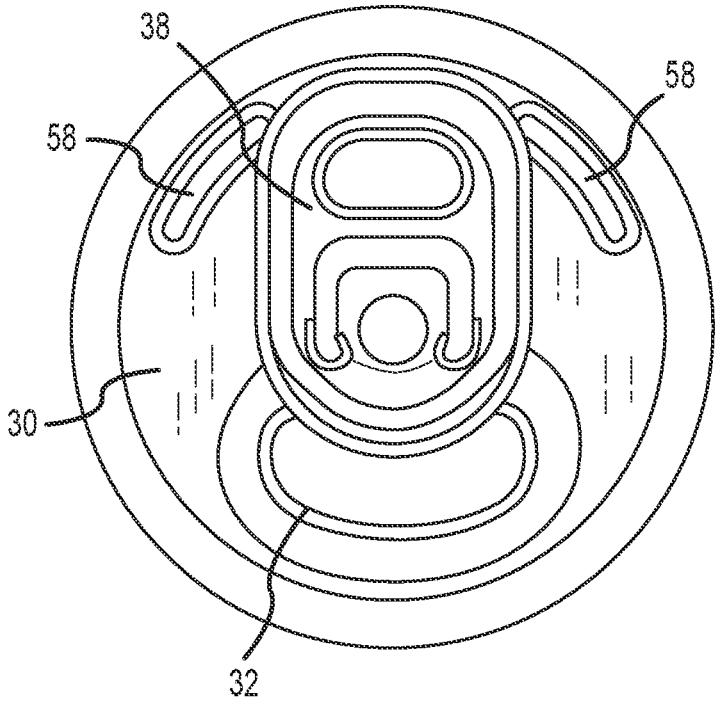
FIG. 10 shows a can lid according to FIG. 9A with the pull tab rotated in its opening position.

The ramp-up beads 58 define a gap 52 between them that provides a click-in effect when the pull tab is aligned in its opening position as illustrated in FIG. 10. Thus, the ramp-up beads 58 provide a tactile feedback to a user that helps the user to correctly orientate the pull tab 38 for opening the tear panel 32. Accordingly, the ramp-up beads 58 also serve as orientation beads.

Figure 11B:
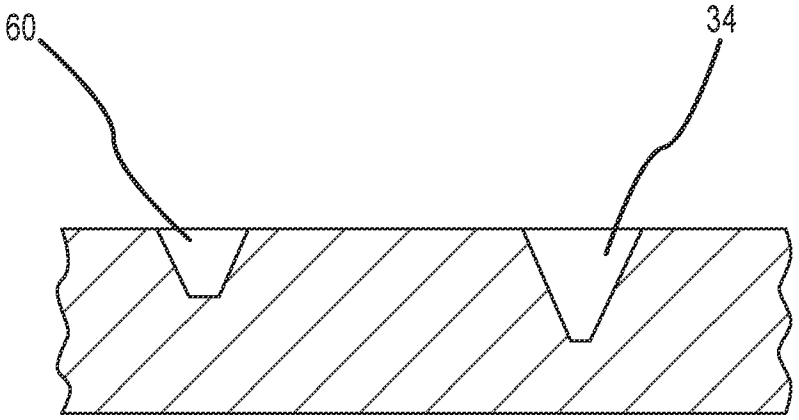
FIG. 11B shows a cross-sectional view of the score line of FIG. 11A along line A-A.
Figure 11A:
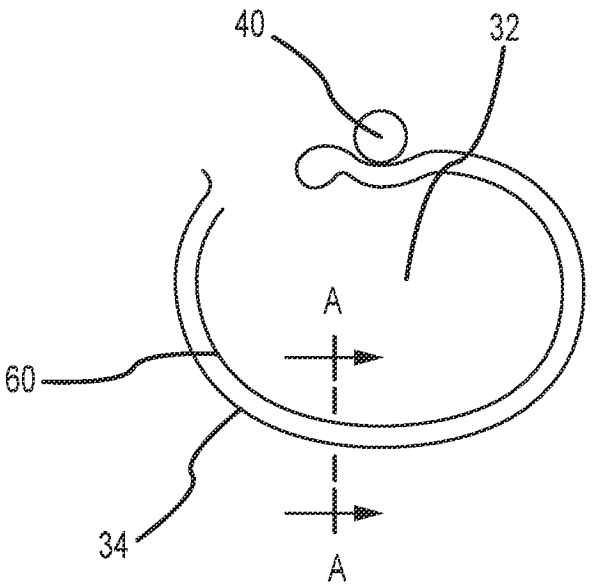
FIG. 11A shows details of a first variant of the score line.

FIGS. 11A and 11B and 12A and 12B show cross-sections of alternative embodiments of score line 34 or 34', respectively. In the embodiment shown in FIGS. 11A and 11B, an anti fracture score 60 is provided that runs in parallel to score line 34. FIG. 11B shows a cross section of the score line taken along line A-A of FIG. 11A. The anti fracture score 60 has the effect to lower the tensile stress near the deepest portion of the score line 34 and thus avoids an unwanted fracture of the score line prior to intended opening of the tear panel 32.

Figure 12B:
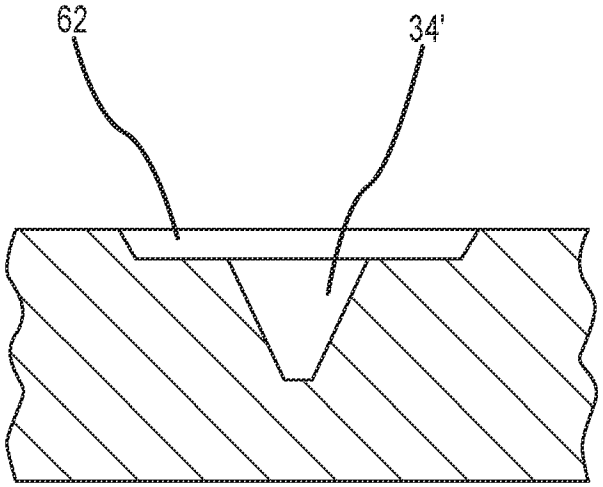
FIG. 12B shows a cross-sectional view of the score line of FIG. 12A along line B-B.
Figure 12A:
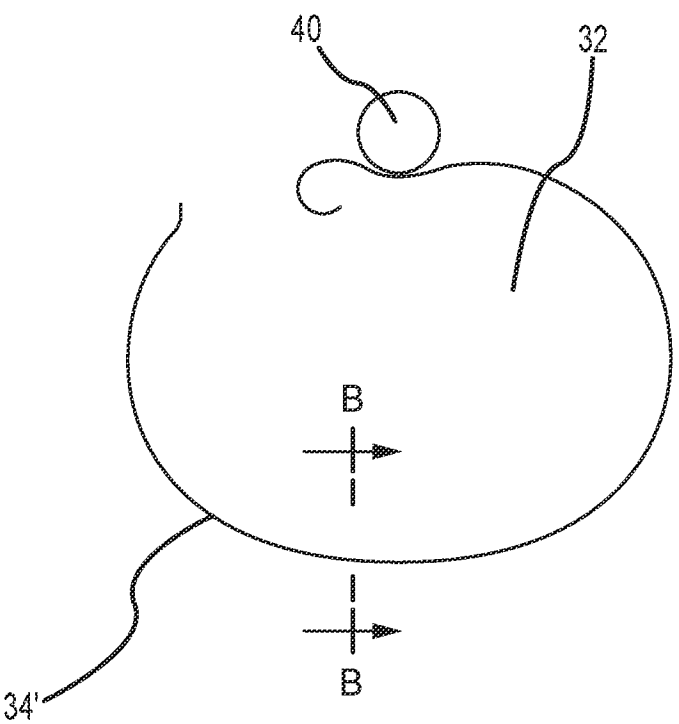
FIG. 12A shows details of a second variant of the score line.

In the alternative embodiment shown in FIGS. 12A and 12B, a background penetration 62 is provided that runs along the score line 34'. Similar to the anti fracture score 60 of FIGS. 11A and 11B, the background penetration 62 has the effect to lower the tensile stress near the deepest portion of score line 34' and thus avoids an unwanted fracture of the score line prior to intended opening of the tear panel 32. FIG. 12B shows a cross section of the score of FIG. 12A taken along line B-B.

LIST OF REFERENCE NUMERALS

10 Can
12 Can body
14 Can lid
16 Base
18 Sidewall
20 Neck
22 Stand ring
24 Dome
26 Chuck wall
28 Countersink
30 Central panel
32 Tear panel
34 Score line
35 Arrow indicating closest distance between panel radius and the score line
36 Absorption bead
37 Arrow indicated apex of score line
38 Pull Tab
40 Rivet
41 Double Seam
42 Handle part
44 Opening part
46 Longitudinal axis of can body
46 Panel radius
50 Rivet island
52 Gap
54 Pull tab curl
56 Triangular extension (shark fin)
58 Ramp-up bead
60 Anti fracture score
62 Background penetration
A Maximum diameter
B Plug diameter
E Can height
F Base height
G Cylindrical sidewall height
H Neck height
J Stand ring diameter
K Curl diameter
L Seam diameter
Q Central panel diameter
R Can lid plug diameter

What is claimed is:

1. A can lid for an aluminum beverage can, comprising:
a curl for interconnecting the can lid to a neck of the aluminum beverage can;
a chuck wall extending inwardly from the curl;
a countersink interconnected to the chuck wall; and
a central panel interconnected to the countersink and having a panel radius, a diameter that is not greater than approximately 40 mm, a score line defining a tear panel and a rivet for connecting a pull tab to the can lid,
wherein the rivet is tilted at an angle of between 1° and 9° with respect to a line normal to a plane defined by the countersink such that an upper surface of the pull tab is oriented at an acute angle to the plane and a lift end of the pull tab is elevated above the central panel when the pull tab is in an opening position, wherein the tear panel has an area of between approximately 24% to approximately 34% of an area of the central panel, wherein the central panel has an axis defined by the rivet and a center of the tear panel, and wherein an outermost portion of the score line is offset from the axis, the outermost portion of the score line positioned less than approximately 3 mm from the panel radius.

2. The can lid according to claim 1, wherein the rivet is arranged at or near a center of the central panel.

3. The can lid according to claim 1, wherein the pull tab has a rivet island that is affixed to the central panel by the rivet.

4. The can lid according to claim 3, wherein the rivet island defines a plane that is tilted by an angle of between approximately 2° and approximately 4° with respect to the plane defined by the countersink.

5. The can lid according to claim 1, wherein the area of the tear panel is less than approximately 350 $mm^2$.

6. The can lid according to claim 1, wherein the pull tab has an axis of symmetry and can rotate about the rivet, and wherein the pull tab initially is orientated in a stored position with the axis of symmetry at an angle of between approximately 5° to 30° with respect to the axis of the central panel defined by the rivet and the center of the tear panel.

7. The can lid according to claim 6, further comprising at least one ramp-up bead arranged on either side or both sides of the axis of the central panel to elevate the lift end of the pull tab, the at least one ramp-up bead extending proximate to a perimeter of the central panel.

8. The can lid according to claim 6, further comprising a first ramp-up bead arranged on a first side of the axis of the central panel and a second ramp-up bead arranged on a second side of the axis of the central panel, the first ramp-up bead having a first run and the second ramp-up bead having a second run that is approximately equal to the first run, the ramp-up beads defining a gap between them that is configured to provide a tactile feedback to a user when the pull tab is rotated from the stored position off-set from the ramp up beads and reaches the opening position suitable for opening the tear panel.

9. The can lid according to claim 8, wherein an upper surface of the first ramp-up bead is continuous between a beginning and an upper end, and wherein an upper surface of the second ramp-up bead is continuous between a beginning and an upper end.

10. The can lid according to claim 1, wherein a shortest distance between the score line and the panel radius is less than approximately 1.1 mm.

11. The can lid according claim 1, wherein the can lid is made from an aluminum or a steel.

12. The can lid of claim 1, wherein the pull tab is configured to rotate around the rivet from a stored position with an opening end rotated away from the tear panel to the opening position with the opening end positioned above the tear panel and with the lift end of the pull tab spaced from the central panel.

13. The can lid of claim 1, wherein a distance between the score line and the panel radius at the axis is 1.41 mm.

14. The can lid of claim 13, wherein the outermost portion of the score line is positioned 0.99 mm from the panel radius.

15. The can lid of claim 1, further comprising a background penetration formed in the central panel that is configured to lower a tensile strength of the score line, the background penetration comprising a first width and a first depth, and wherein the first width is greater than a widest portion of the score line and the first depth is less than a maximum depth of the score line.

16. The can lid of claim 1, wherein the acute angle is about 3°.

17. The can lid of claim 1, wherein the central panel has a thickness of less than 0.19 mm, and wherein the can lid has a weight of less than 1.9 grams.

18. The can lid of claim 1, wherein the central panel has a second axis that is perpendicular to the axis defined by the rivet and the center of the tear panel and the second axis extends through the rivet, and wherein on one side of the axis the score line extends from a first side of the second axis to a second side of the second axis to improve pouring.

* * * * *